US007216604B2

(12) United States Patent
Finney et al.

(10) Patent No.: US 7,216,604 B2
(45) Date of Patent: May 15, 2007

(54) RETRACTABLE ARCH SYSTEM FOR A BOAT

(75) Inventors: William G. Finney, East Palatka, FL (US); Glenn M. Henderson, Saint Augustine, FL (US); Jason Minehart, Palm Coast, FL (US)

(73) Assignee: Hunter Marine Corporation-A Florida Corporation, Alachua, FL (US)

( * ) Notice: Subject to any disclaimer, the term of this patent is extended or adjusted under 35 U.S.C. 154(b) by 0 days.

(21) Appl. No.: 11/246,643

(22) Filed: Oct. 7, 2005

(65) Prior Publication Data

US 2007/0079746 A1 Apr. 12, 2007

(51) Int. Cl.
*B63B 17/00* (2006.01)

(52) U.S. Cl. ..... 114/361

(58) Field of Classification Search ..... 114/361, 114/364, 343, 253

See application file for complete search history.

(56) References Cited

U.S. PATENT DOCUMENTS

| | | | | |
|---|---|---|---|---|
| 5,931,114 | A * | 8/1999 | Bartholomew | 114/361 |
| 6,192,819 | B1 * | 2/2001 | Larson et al. | 114/253 |
| 6,374,762 | B1 * | 4/2002 | Larson et al. | 114/253 |
| 6,666,159 | B2 * | 12/2003 | Larson et al. | 114/253 |
| 6,854,413 | B2 * | 2/2005 | Jackson et al. | 114/343 |

OTHER PUBLICATIONS http://www.huntermarine.com/models/303/306-phot.html; Hunter 306—Photo Gallery; Apr. 25, 2005.

http://www.huntermarine.com/models/426ac/426-photo.html; Hunter 44 Aft Cockpit—Photo Gallery; Apr. 25, 2005.

http://www.huntermarine.com/discover/page2.html; Discover the Hunter Difference; Apr. 25, 2005.

http://www.huntermarine.com/models/466/466-photo.html; Hunter 466—Photo Gallery; Apr. 25, 2005.

http://www.huntermarine.com/models/456/456-photo.html; Hunter Passage 456—Photo Gallery; Apr. 25, 2005.

http://www.huntermarine.com/models/426DS/426-photo.html; Hunter 44 Deck Salon—Photo Gallery; Apr. 25, 2005.

Boat Test—Hunter 38; John Kretschmer; Photos by Walter Cooper; Sailing Magazine, Feb. 2005.

http://www.wellsmarine.com/index/html; Wells Marine Arch Davit; Apr. 25, 2005.

http://www.wellsmarine.com/measure.html; Wells Marine Measurments Page; Apr. 25, 2005.

http://www.wellsmarine.com/hunter/hunter/html; Hunter Sailboats With A Wells Arch Davit; Apr. 25, 2005.

http://www.wellsmarine.com/hunter/images/hunter420-10.jpg; Apr. 25, 2005.

(Continued)

*Primary Examiner*—Lars A. Olson
(74) *Attorney, Agent, or Firm*—RatnerPrestia

(57) ABSTRACT

A retractable arch system for a boat is provided that includes at least four substantially vertical legs for permanent installation on the boat. A first traverse member forms a first arch and is removably coupled by first and second separable couplings to two of the legs. A second traverse member forms a second arch and is pivotally coupled by first and second pivotal couplings to the other two of the legs. The system has an upright position for extending of the first and second arches and securing the first and second separable couplings. The system further has a retracted position in which the first and second separable couplings are disassembled and the arches are pivoted downwardly.

18 Claims, 6 Drawing Sheets

OTHER PUBLICATIONS http://www.wellsmarine.com/hunter/images/hunter375-5.jpg; Apr. 25, 2005.
http://www.wellsmarine.com/hunter/images/hunter420-12.jpg; Apr. 25, 2005.
http://www.wellsmarine.com/hunter/images/hunter420-13.jpg; Apr. 25, 2005.
http://www.atlantictowers.com/cflsharch.htm; Atlantic Towers—Custom Fishing Arch; Apr. 25, 2005.
http://www.atlantictowers.com/products.htm; Atlantic Towers—Products; Apr. 25, 2005.
http://www.coxcustomwelding.net/arch%20prices.doc2a.htm; Cox Custom Welding & Design; Apr. 25, 2005.

* cited by examiner

RETRACTABLE ARCH SYSTEM FOR A BOAT

BACKGROUND OF THE INVENTION

Arch systems for boats are typically used, for example, to keep the cockpit of the boat clear and safe. An arch system can support a variety of components including a traveler, a bimini, stereo speakers, cockpit lights, a radar system, a global positioning system (GPS), and radio antennas.

Arch systems can be difficult to fabricate, install, remove, and repair. Furthermore, the rigid structure of an arch system makes it an awkward appendage during delivery of the boat on which it has been permanently installed. The arch system extends upwardly from the boat and may not clear tunnels and bridges through which the boat carrier must pass during on-the-road delivery. Accordingly, conventional arch systems typically must be disassembled and removed during shipping. Upon arrival at a boat dealer, for example, the boat dealer must assemble a conventional arch system by bolting it back to the boat.

Accordingly, there remains a need for a simplified arch system that facilitates, among other things, easier transporting, wire installation, and repair.

SUMMARY OF THE INVENTION

In one embodiment, a retractable arch system for a boat includes at least four substantially vertical legs for permanent installation on the boat. A first traverse member forms a first arch and is removably coupled by first and second separable couplings to two of the legs. A second traverse member forms a second arch and is pivotally coupled by first and second pivotal couplings to the other two of the legs. The system has an upright position for extending of the first and second arches and securing the first and second separable couplings. The system further has a retracted position in which the first and second separable couplings are disassembled and the arches are pivoted downwardly.

In another embodiment, a retractable arch system for a boat includes two substantially vertical forward legs permanently and rigidly fixed on the boat, wherein the legs are positioned forward with respect to the boat. Two substantially vertical aft legs are permanently and rigidly fixed on the boat, wherein the legs are positioned aft with respect to the boat. A forward traverse member forms a forward arch and is removably coupled by port and starboard separable couplings to the forward legs. An aft traverse member forms an aft arch and is pivotally coupled by port and starboard pivotal couplings to the aft legs. The system has an upright position for extending of the forward and aft arches and securing the port and starboard separable couplings. The system further has a retracted position in which the port and starboard separable couplings are disassembled and the arches are pivoted downwardly.

In yet another embodiment, a retractable arch system for a boat includes two substantially vertical forward legs permanently and rigidly fixed on the boat, wherein the legs are positioned forward with respect to the boat. Two substantially vertical aft legs are permanently and rigidly fixed on the boat, wherein the legs are positioned aft with respect to the boat. A forward traverse member forms a forward arch and is pivotally coupled by port and starboard pivotal couplings to the forward legs. An aft traverse member forms an aft arch and is removably coupled by port and starboard separable couplings to the aft legs. The system has an upright position for extending of the forward and aft arches and securing the port and starboard separable couplings. The system further has a retracted position in which the port and starboard separable couplings are disassembled and the arches are pivoted downwardly.

In another embodiment, a method of retracting an arch system for a boat is provided. The arch system has two substantially vertical forward legs permanently and rigidly fixed on the boat, the forward legs positioned forward with respect to the boat. The arch system further has two substantially vertical aft legs permanently and rigidly fixed on the boat, the aft legs positioned aft with respect to the boat. A forward arch is formed from a forward traverse member, removably coupling the forward traverse member by port and starboard separable couplings to the forward legs. An aft arch is formed from an aft traverse member, pivotally coupling the after traverse member by port and starboard pivotal couplings to the aft legs. The system is moved to an upright position by extending the forward and aft arches and securing the port and starboard separable couplings. The system is moved to a retracted position by disassembling the port and starboard separable couplings and pivoting the arches downwardly.

In yet another embodiment, a method of retracting an arch system for a boat is provided. The arch system has two substantially vertical forward legs permanently and rigidly fixed on the boat, the forward legs positioned forward with respect to the boat. The arch system further has two substantially vertical aft legs permanently and rigidly fixed on the boat, the aft legs positioned aft with respect to the boat. A forward arch is formed from a forward traverse member, pivotally coupling the forward traverse member by port and starboard pivotal couplings to the forward legs. An aft arch is formed from an aft traverse member, removably coupling the after traverse member by port and starboard separable couplings to the aft legs. The system is moved to an upright position by extending the forward and aft arches and securing the port and starboard separable couplings. The system is moved to a retracted position by disassembling the port and starboard separable couplings and pivoting the arches downwardly.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

Figure 1:
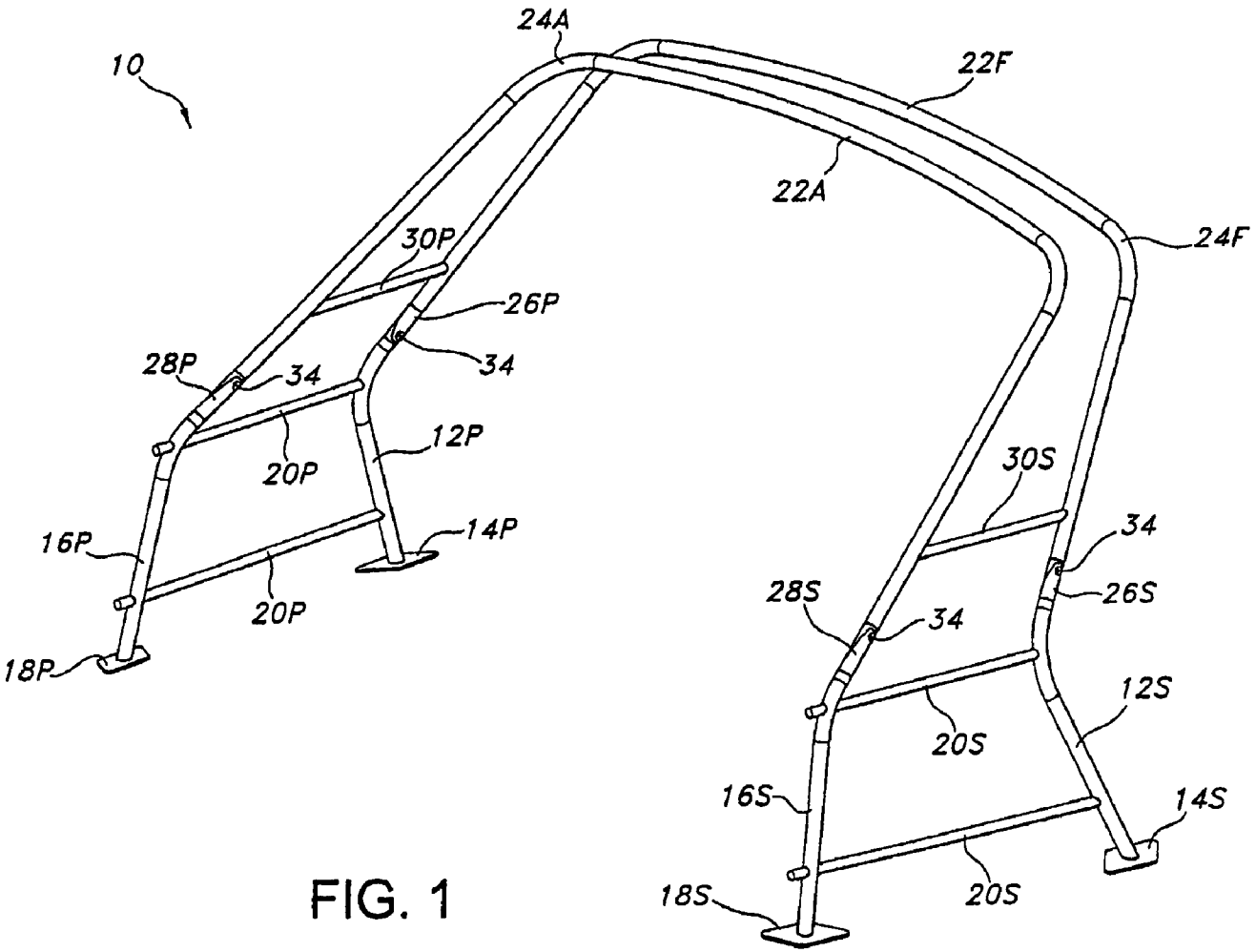
FIG. 1 is a perspective view of a retractable arch system for a boat comprised of legs and traverse members, in an upright position, as viewed from the aft end of the boat.
Figure 2:
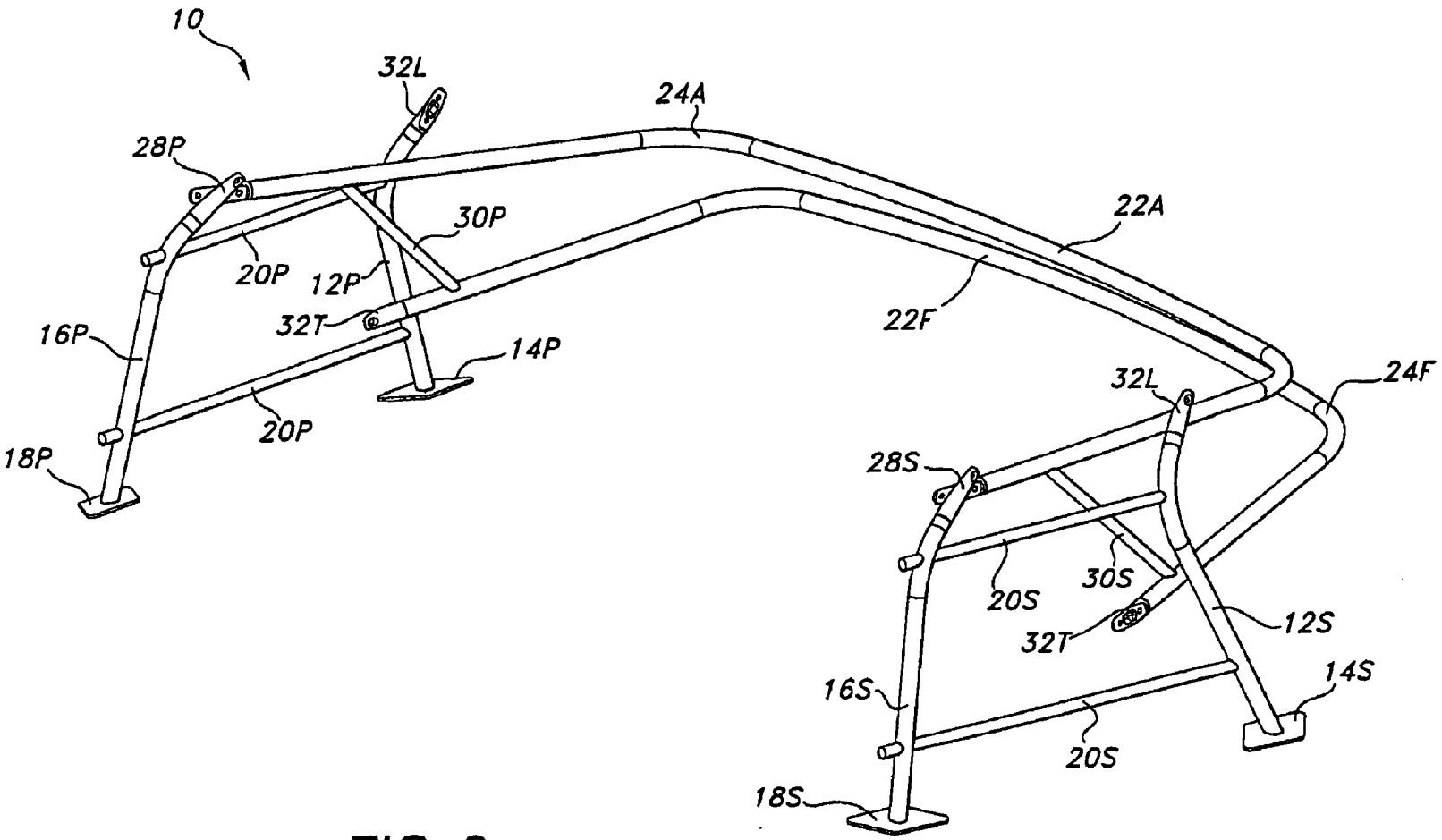
FIG. 2 is a perspective view of the embodiment illustrated in FIG. 1, showing the arch system in a retracted position.

Referring to FIGS. 1 and 2, 10 includes two substantially vertical forward legs 12P, 12S permanently and rigidly fixed on the boat at the location of plates 14P, 14S, wherein legs 12P, 12S are positioned forward with respect to the boat. Two substantially vertical aft legs 16P, 16S are permanently and rigidly fixed on the boat at the location of plates 18P, 18S, wherein legs 16P, 16S are positioned aft with respect to the boat. Port and starboard support members 20P, 20S connect the forward and aft legs 12P, 12S, 16P, 16S to each other. Support members 20P, 20S provide structural rigidity for arch system 10. Plates 14P, 14S, 18P, and 18S may be fixed to the boat via fasteners, welds, or any other securement method that rigidly fixes vertical legs 12P, 125, 16P, 16S on the boat and sufficiently supports arch system 10.

A forward traverse member 22F forms a forward arch 24F and is removably coupled by port and starboard separable couplings 26P, 26S to forward legs 12P, 12S. An aft traverse member 22A forms an aft arch 24A and is pivotally coupled by port and starboard pivotal couplings 28P, 28S to aft legs 16P, 16S. A port and starboard support member 30P, 30S each connects the forward and aft arches 24F, 24A to each other. Support members 30P, 30S provide structural rigidity for arch system 10 and enable forward traverse member 22F to be manipulated in conjunction with aft traverse member 22A, as will be described in greater detail below.

Legs 12P, 12S, 16P, 165, support members 20P, 20S, traverse members 22F, 22A, and support members 30P, 30S may be hollow members. An exemplary material for forming arch system 10 is stainless steel tubing. The present invention, however, is not limited to stainless steel tubing, and may include hollow or solid members of aluminum, titanium, composite material, or any other material that offers the desired structure and rigidity.

System 10 has an upright position, as represented in FIG. 1, for extending of the forward and aft arches 24F, 24A and securing the port and starboard separable couplings 26P, 26S. System 10 further has a retracted position, as represented in FIG. 2, in which the port and starboard separable couplings 26P, 26S are disassembled (and represented in FIG. 2 as separable coupling components 32L, 32T) and the arches 24F, 24A are pivoted downwardly. Each separable coupling component 32L is affixed to one of the forward legs 12P, 12S. Each separable coupling component 32T is affixed to forward traverse member 22F and configured to mate with its corresponding separable coupling component 32L to form port and starboard separable couplings 26P, 26S (as illustrated in FIG. 1). Fasteners 34 secure mating components 32T, 32L together.

The port and starboard separable couplings 26P, 26S are identical and interchangeable for ease of fabrication and assembly. Similarly, separable coupling components 32L, 32T are identical and interchangeable, also simplifying fabrication and assembly. As such, FIGS. 3A and 4A represent one of either the port or starboard separable couplings 26P, 26S and denote it with reference numeral 26. Similarly, FIGS. 3B, 3C, 4B–4D represent one of either separable coupling components 32L, 32T and denote it with reference numeral 32.

Referring to FIGS. 3A and 4A, separable coupling 26 is shown with components 32 mated together as illustrated in the upright position of arch system 10 in FIG. 1. Each of components 32 includes an end portion 36 for insertion into hollow is forward legs 12P, 12S at one end of a particular separable coupling 26 and for insertion into hollow forward traverse member 22F at the other end of the particular separable coupling 26. The end of each forward leg 12P, 12S and each end of traverse member 22F abuts respective chamfers 38 of the respective coupling 26 (i.e., component 32). The seam formed at each abutment is welded to permanently affix components 32 to their respective leg 12P, 12S or traverse member 22F.

Figure 3B:
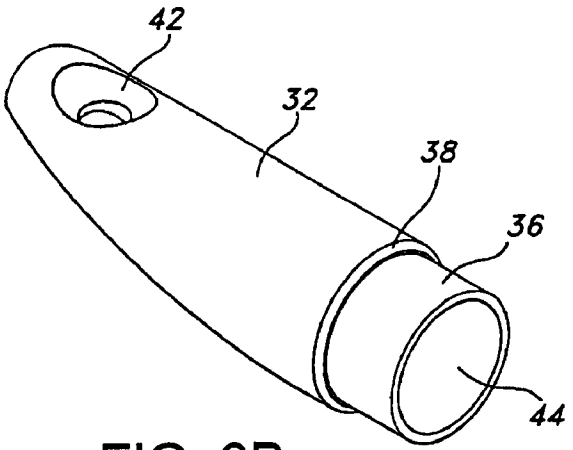
FIG. 3B is a perspective view of one of the separable coupling components illustrated in FIG. 3A, showing an external surface of the separable coupling component.
Figure 3C:
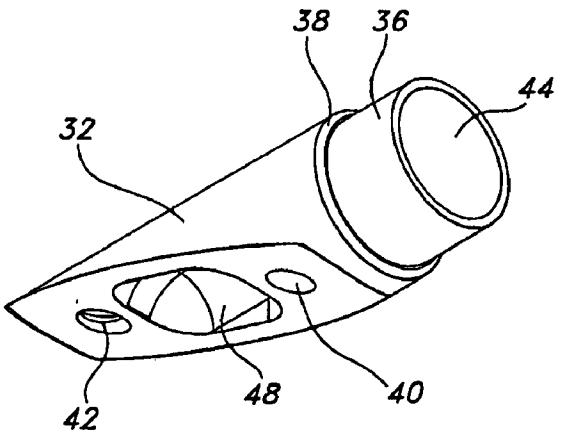
FIG. 3C is a perspective view of one of the separable coupling components illustrated in FIG. 3A, showing an internal surface of the separable coupling component.
Figure 3A:
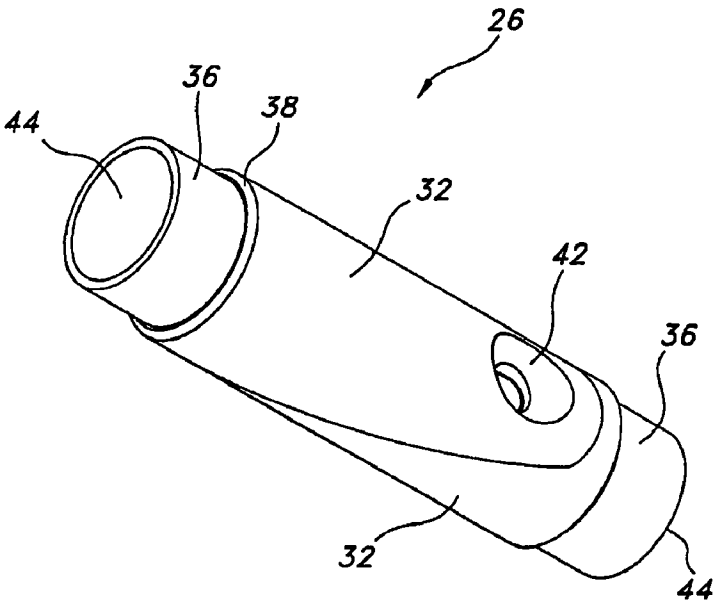
FIG. 3A is a perspective view of a separable coupling for removably coupling a traverse member of the arch system of FIG. 1 to its respective legs.
Figure 4B:
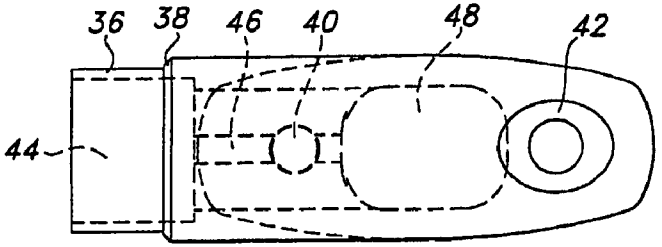
FIG. 4B is a top view of one of the separable coupling components illustrated in FIG. 3A, showing an external surface of the separable coupling component.
Figure 4C:
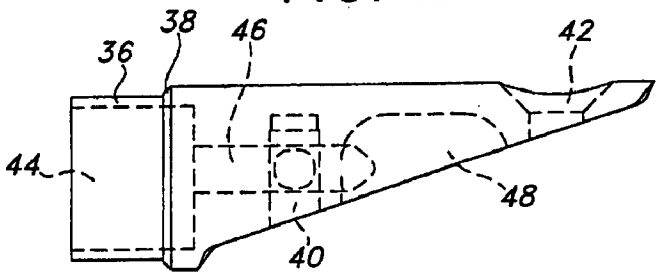
FIG. 4C is a side view of one of the separable coupling components illustrated in FIG. 3A.
Figure 4D:
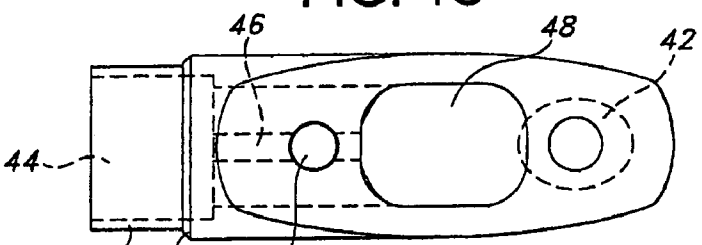
FIG. 4D is a bottom view of one of the separable coupling components illustrated in FIG. 3A, showing an internal surface of the separable coupling component.
Figure 4A:
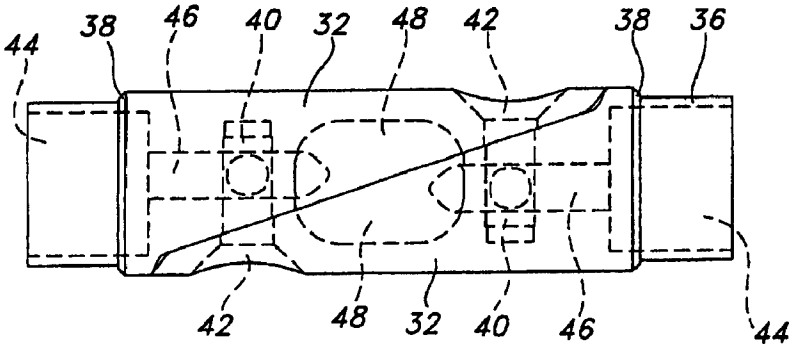
FIG. 4A is a side view of the separable coupling illustrated in FIG. 3A.

FIGS. 3B and 3C are different perspective views of separable coupling component 32. Component 32 includes a threaded aperture 40 and a countersunk aperture 42. When a pair of components 32 is mated as illustrated in FIGS. 1, 3A, and 4A, the threaded aperture 40 of each component 32 aligns with its respective countersunk aperture 42 on its mating component 32, as illustrated in FIG. 4A. Fasteners 34 (represented in FIG. 1, not shown in FIG. 4A) are installed through countersunk apertures 42 and into threaded apertures 40 to removably couple forward traverse member 22F of its respective forward leg 12P, 12S, as illustrated in FIG. 1. The removable feature realized by fasteners 34 will be described in greater detail below.

Referring to FIGS. 4A–4D, each component 32 further includes an end portion aperture 44, a passageway 46, and a channel 48. Wires or cables (not shown) may be installed within hollow forward legs 12P, 12S and hollow forward traverse member 22F to operate electronic equipment supported by arch system 10. The hollow design of separable coupling 26 facilitates this configuration. More specifically, the wires or cables run up through a hollow forward leg 12P, 12S, through end portion aperture 44 of a particular component 32, through passageway 46 of that particular component, through channel 48 of that particular component 32, through channel 48 of a mating component 32, through passageway 46 of mating component 32, through end portion aperture 44 of mating component 32, and though hollow forward traverse member 22F to a particular electronic device.

The port and starboard pivotal couplings 28P, 28S are identical and interchangeable for ease of fabrication and assembly. Pivotal couplings 28P, 28S comprise pivotal coupling components 50 that are also identical and interchangeable, also simplifying fabrication and assembly. As such, FIGS. 5A and 6A represent one of either the port or starboard pivotal couplings 28P, 28S and denote it with reference numeral 28. Similarly, FIGS. 5B, 5C, 6B–6D represent one of either pivotal coupling components 50, as denoted.

Referring to FIGS. 5A and 6A, pivotal coupling 28 is shown with components 50 mated together as illustrated in the upright position of arch system 10 in FIG. 1. Each of components 50 includes an end portion 52 for insertion into hollow aft legs 16P, 16S at one end of a particular pivotal coupling 28 and for insertion into hollow aft traverse member 22A at the other end of the particular pivotal coupling 28. The end of each aft leg 16P, 16S and each end of traverse member 22A abuts respective chamfers 54 of the respective coupling 28 (i.e., component 50). The seam formed at each abutment is welded to permanently affix components 50 to their respective leg 16P, 16S or traverse member 22A.

Figure 5B:
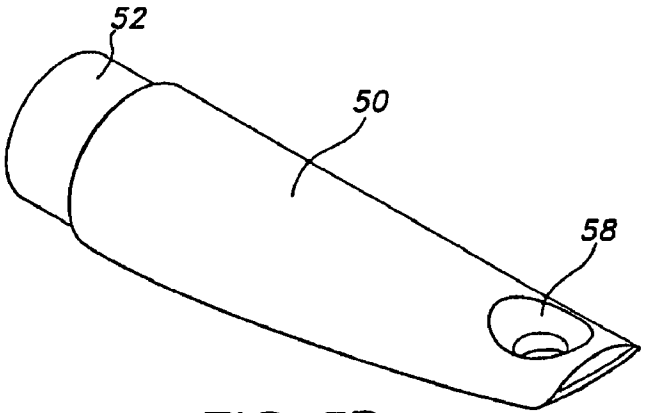
FIG. 5B is a perspective view of one of the pivotal coupling components illustrated in FIG. 5A, showing an external surface of the pivotal coupling component.
Figure 5C:
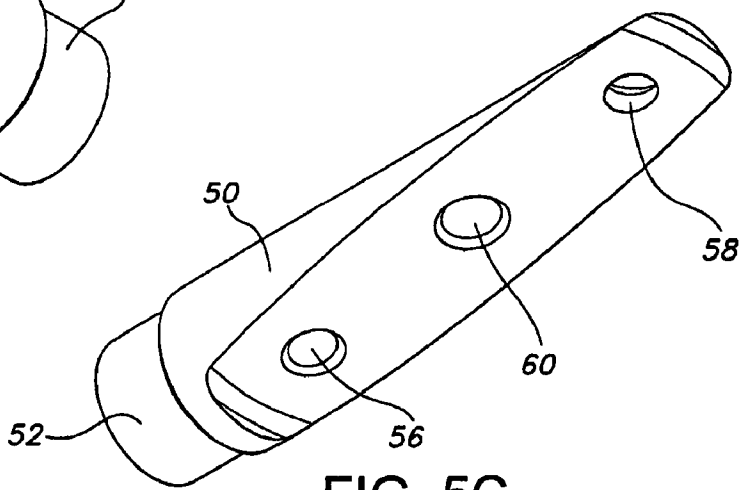
FIG. 5C is a perspective view of one of the pivotal coupling components illustrated in FIG. 5A, showing an internal surface of the pivotal coupling component.
Figure 5A:
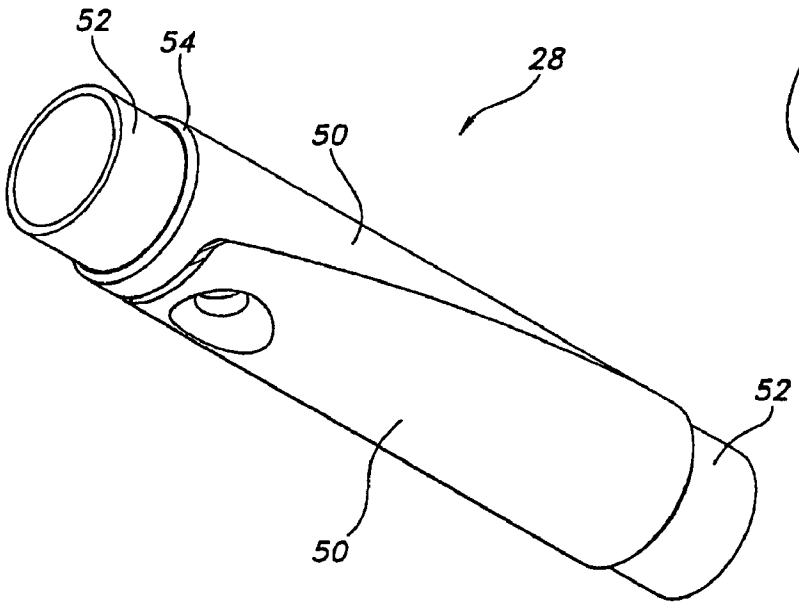
FIG. 5A is a perspective view of a pivotal coupling for pivotally coupling a traverse member of the arch system of FIG. 1 to its respective legs.
Figure 6B:
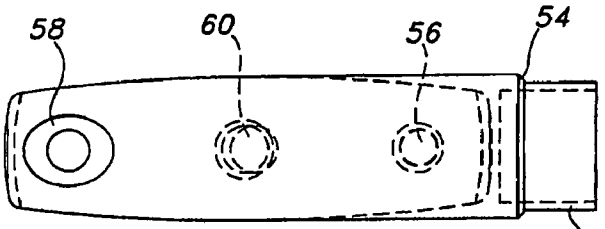
FIG. 6B is a top view of one of the pivotal coupling components illustrated in FIG. 5A, showing an external surface of the pivotal coupling component.
Figure 6C:
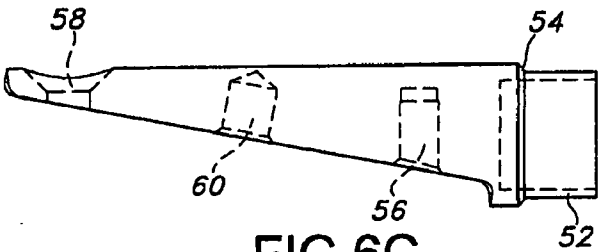
FIG. 6C is a side view of one of the pivotal coupling components illustrated in FIG. 5A.
Figure 6D:
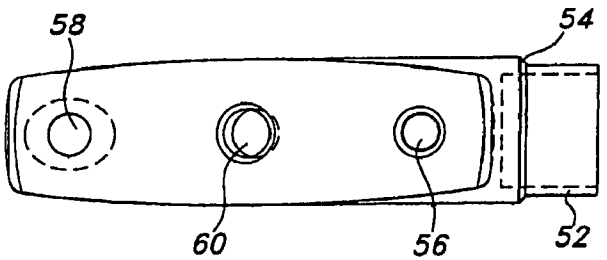
FIG. 6D is a bottom view of one of the pivotal coupling components illustrated in FIG. 5A, showing an internal surface of the pivotal coupling component.
Figure 6A:
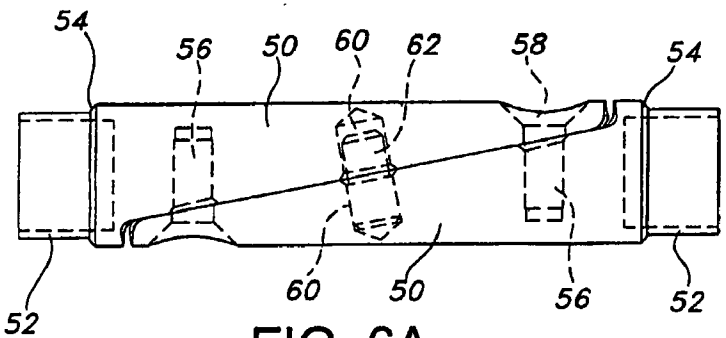
FIG. 6A is a side view of the pivotal coupling illustrated in FIG. 5A.

FIGS. 5B and 5C are different perspective views of pivotal coupling component 50. Component 50 includes a threaded aperture 56 and a countersunk aperture 58. When a pair of components 50 is mated as illustrated in FIGS. 1, 5A, and 6A, the threaded aperture 56 of each component 50 aligns with its respective countersunk aperture 58 on its mating component 50, as illustrated in FIG. 6A. Fasteners 34 (represented in FIG. 1, not shown in FIG. 6A) are installed through countersunk apertures 58 and into threaded apertures 56 to maintain arch system 10 in its upright position. Removal of fasteners 34 will be described in greater detail below.

Referring to FIGS. 5C–6D, each component 50 further includes a pivoting aperture 60. A stud 62 is inserted into each pivoting aperture 60 of a pair of components 50 to form a pivotal coupling 28, as illustrated in FIG. 6A. Stud 62 connects components 50 together while permitting pivoting of components 50 relative to one another to form pivotal coupling 26. As explained above, when fasteners 34 are installed (as represented in FIG. 1) arch system 10 is maintained in its upright position. In this position, fasteners 34 prevent components 50 from pivoting. The removal of fasteners 34 allows components 50 to pivot with respect to each other around stud 62 such that arch system 10 may be manipulated to its retracted position as illustrated in FIG. 2.

An exemplary material for forming separable couplings 26 and pivotal couplings 28 is casted stainless steel. The present invention, however, is not limited to casted stainless steel, and may include casted aluminum, titanium, composite material, or any other material that offers the desired structure and strength.

In use, arch system 10 is illustrated in its upright position in FIG. 1. In this upright position, separable couplings 26P, 26S are mated together and secured, via fasteners 34, as described above. Accordingly, forward traverse member 22F is removably coupled to forward legs 12P, 12S. In other words, in the upright position, forward traverse member 22F is fixed to forward legs 12P, 12S via removable fasteners 34. Similarly, pivotal couplings 28P, 28S are mated together and secured, via fasteners 34 and stud 62, as described above. Accordingly, aft traverse member 22A is pivotally coupled to aft legs 16P, 16S. In other words, in the upright position, aft traverse member 22A is fixed to aft legs 16P, 16S via stud 62 and removable fasteners 34. Fasteners 34 prevent pivotal couplings 28P, 28S from pivoting in the upright position of arch system 10.

To manipulate arch system 10 from its upright position (as illustrated in FIG. 1) to its retracted position (as illustrated in FIG. 2), fasteners 34 are removed from separable couplings 26P, 26S and pivotal couplings 28P, 28S. Components 32T of separable couplings 26P, 26S are separated from their respective components 32L, while components 50 of pivotal couplings 22P, 22S remain connected to each other via stud 62.

As explained above, stud 62 permits pivoting of components 50 relative to one another. The removal of fasteners 34 allows components 50 to pivot with respect to each other around stud 62 such that arch system 10 may be manipulated to its retracted position as illustrated in FIG. 2. Aft traverse member 22A is moved forward (towards the right in FIGS. 1 and 2) and downwardly while pivotally connected to aft legs 16P, 16S at stud 62 of pivotal coupling 26. Because port and starboard support members 30P, 30S connect the forward and aft arches 24F, 24A to each other, forward traverse member 22F (which has been disconnected from forward legs 12P, 12S) moves forward and downwardly in conjunction with the movement of aft traverse member 22A.

Alternatively, to manipulate arch system 10 from its upright position to its retracted position, forward and aft arches 24F, 24A may be moved rearward (as opposed for forward) and downwardly in conjunction with each other. It will be understood that arch system 10 may be configured such that forward arch 24F is pivotally coupled by port and starboard pivotal couplings 28P, 28S to forward legs 12P, 12S, and aft arch 24A is removably coupled by port and starboard separable couplings 26P, 26S to aft legs 16P, 16S to facilitate such rearward movement, as desired.

The retracted position of arch system 10 as illustrated in FIG. 2 (and the ease with which it is achieved) is desirable, for example, during delivery of the boat on which it is installed. More specifically, the rigid structure of a conventional arch system makes it an awkward appendage that increases the profile of the cockpit area and is susceptible to tunnels, bridges, lines, and equipment getting caught on it when the boat is being transported. The retractable feature of arch system 10 of the present invention streamlines the profile of the cockpit without having to actually remove the arch system 10. Furthermore, the configuration of removable couplings 26 and pivotal couplings 22 make arch system 10 of the present invention easier to fabricate, install, remove, and repair than conventional arch systems.

Arch system 10 of the present invention can support a variety of components including, but not limited to, a traveler, a bimini, stereo speakers, cockpit lights, a radar system, a GPS, and radio antennas. As explained above, wires or cables are installed within hollow forward legs 12P, 12S and hollow forward traverse member 22F to operated electronic equipment supported by arch system 10. Also as explained above, the hollow design of separable coupling 26 facilitates this configuration. Arch system 10 of the present invention is also desirable, for example, during winterization of the boat on which it is installed. More specifically, the bimini and various electronic components supported by arch system 10 can be easily removed and stored, as desired.

While preferred embodiments of the invention have been shown and described herein, it will be understood that such embodiments are provided by way of example only. Numerous variations, changes, and substitutions will occur to those skilled in the art without departing from the spirit of the invention. For example, due to the ease with which separable couplings 26P, 26S and pivotal couplings 28P, 28S may be disassembled, forward and aft arches 24F, 24A can be easily removed for an alternative configuration, as desired. In this configuration, forward legs 12P, 12S and aft legs 16P, 16S remain permanently and rigidly fixed on the boat with wires or cables protruding from the hollow legs to power the operation of electronic equipment. When not in use, protruding wires or cables may be capped off for safety purposes. Accordingly, it is intended that the appended claims cover all such variations as fall within the spirit and scope of the invention.

What is claimed is:

1. A retractable arch system for a boat comprising:

at least four substantially vertical legs for permanent installation on the boat;

a first traverse member forming a first arch and removably coupled by first and second separable couplings to first of two of said legs; and a second traverse member forming a second arch and pivotally coupled by first and second pivotal couplings to a second of two of said legs;

wherein said system has an upright position for extending of said first and second arches and securing said first and second separable couplings, and a retracted position in which said first and second separable couplings are disassembled and said first and second arches are pivoted downwardly; and in the retracted position the arch system is configured in which all portions of the first and second arches are at an elevation below the at least four substantially vertical legs and the first and second separable couplings of the first arch extend internally between the first two of said legs.

2. The retractable arch system of claim 1 further comprising at least two support members connecting said legs.

3. The retractable arch system of claim 1 further comprising at least two support members connecting said arches.

4. The retractable arch system of claim 1, wherein each of said first and second separable couplings comprises:

one component affixed to one of said legs;

another component affixed to said first traverse member and configured to mate with said other component; and at least one fastener for securing said mating components together.

5. The retractable arch system of claim 1, wherein each of said first and second pivotal couplings comprises:

one component affixed to one of said legs;

another component affixed to said second traverse member and configured to mate with said other component;

a pivoting fastener pivotally connecting said mating components together; and at least one fixed fastener for securing said mating components together to prevent pivoting.

6. The retractable arch system of claim 5, wherein said pivoting fastener comprises a stud, and said at least one fixed fastener comprises a bolt.

7. A retractable arch system for a boat comprising:

two substantially vertical forward legs permanently and rigidly fixed on the boat, said legs positioned forward with respect to the boat;

two substantially vertical aft legs permanently and rigidly fixed on the boat, said legs positioned aft with respect to the boat;

a forward traverse member forming a forward arch and removably coupled by port and starboard separable couplings to said forward legs; and an aft traverse member forming an aft arch and pivotally coupled by port and starboard pivotal couplings to said aft legs;

wherein said system has an upright position for extending of said forward and aft arches and securing said port and starboard separable couplings, and a retracted position in which said port and starboard separable couplings are disassembled and said arches are pivoted downwardly; and in the retracted position the arch system is configured in which all portions of the forward and aft arches are at an elevation below the at least four substantially vertical legs and the first and second separable couplings of the forward arch extend internally between the two forward legs.

8. The retractable arch system of claim 7 further comprising at least one port and one starboard support member connecting said forward and aft legs to each other.

9. The retractable arch system of claim 7 further comprising at least one port and one starboard support member connecting said forward and aft arches to each other.

10. The retractable arch system of claim 7, wherein each of said port and starboard separable couplings comprises:

one component affixed to one of said forward legs;

another component affixed to said forward traverse member and configured to mate with said other component; and at least one fastener for securing said mating components together.

11. The retractable arch system of claim 7, wherein each of said port and starboard separable couplings comprises:

one component affixed to one of said forward legs;

another component affixed to said forward traverse member and configured to mate with said other component;

at least one fastener for securing said mating components together; and a channel for accommodating said wire.

12. A method of retracting an arch system for a boat having two substantially vertical forward legs permanently and rigidly fixed on the boat, the forward legs positioned forward with respect to the boat and two substantially vertical aft legs permanently and rigidly fixed on the boat, the aft legs positioned aft with respect to the boat comprising the steps of:

(a) forming a forward arch from a forward traverse member, removably coupling the forward traverse member by port and starboard separable couplings to the forward legs;

(b) forming an aft arch from an aft traverse member, pivotally coupling the aft traverse member by port and starboard pivotal couplings to the aft legs;

(c) moving the system to an upright position by extending the forward and aft arches and securing the port and starboard separable couplings;

(d) moving the system to a retracted position by disassembling the port and starboard separable couplings and pivoting the arches downwardly; and (e) configuring the arch system so that in the retracted position all portions of the forward and aft arches are at an elevation below the at least four substantially vertical legs and the first and second separable couplings of the forward arch extend internally between the forward legs.

13. A method of retracting an arch system for a boat having two substantially vertical forward legs permanently and rigidly fixed on the boat, the forward legs positioned forward with respect to the boat and two substantially vertical aft legs permanently and rigidly fixed on the boat, the aft legs positioned aft with respect to the boat comprising the steps of:

(a) forming a forward arch from a forward traverse member, pivotally coupling the forward traverse member by port and starboard pivotal couplings to the forward legs;

(b) forming an aft arch from an aft traverse member, removably coupling the after traverse member by port and starboard separable couplings to the aft legs;

(c) moving the system to an upright position by extending the forward and aft arches and securing the port and starboard separable couplings; and (d) moving the system to a retracted position by disassembling the port and starboard separable couplings and pivoting the arches downwardly; and configuring the arch system so that in the retracted position all portions of the forward and aft arches are at an elevation below the at least four substantially vertical legs and the first and second separable couplings of the aft arch extend internally between the aft legs.

14. A retractable arch system for a boat comprising:

at least four substantially vertical legs for permanent installation on the boat;

a first traverse member forming a first arch and removably coupled by first and second separable couplings to two of said legs;

a second traverse member forming a second arch and pivotally coupled by first and second pivotal couplings to the other two of said legs;

wherein said system has an upright position for extending of said first and second arches and securing said first and second separable couplings, and a retracted position in which said first and second separable couplings are disassembled and said arches are pivoted downwardly; and wherein at least one of said legs and said traverse members is hollow and at least one wire or cable is installed within said at least one hollow leg and traverse member.

15. The retractable arch system of claim 14, wherein each of said first and second separable couplings comprises:

one component affixed to one of said legs;

another component affixed to said first traverse member and configured to mate with said other component;

at least one fastener for securing said mating components together; and a channel for accommodating said wire.

16. A retractable arch system for a boat comprising:

two substantially vertical forward legs permanently and rigidly fixed on the boat, said legs positioned forward with respect to the boat;

two substantially vertical aft legs permanently and rigidly fixed on the boat, said legs positioned aft with respect to the boat;

a forward traverse member forming a forward arch and removably coupled by port and starboard separable couplings to said forward legs;

an aft traverse member forming an aft arch and pivotally coupled by port and starboard pivotal couplings to said aft legs;

wherein said system has an upright position for extending of said forward and aft arches and securing said port and starboard separable couplings, and a retracted position in which said port and starboard separable couplings are disassembled and said arches are pivoted downwardly; and wherein at least one of said forward legs and said forward traverse member are hollow and at least one wire or cable is installed within said at least one forward hollow leg and forward traverse member.

17. The retractable arch system of claim 16, wherein each of said port and starboard pivotal couplings comprises:

one component affixed to one of said aft legs;

another component affixed to said aft traverse member and configured to mate with said other component;

a pivoting fastener connecting said mating components together; and at least one fixed fastener for securing said mating components together to prevent pivoting.

18. The retractable arch system of claim 17, wherein said pivoting fastener comprises a stud, and said at least one fixed fastener comprises a bolt.

* * * * *